US011798484B1

(12) United States Patent
Zhou et al.

(10) Patent No.: US 11,798,484 B1
(45) Date of Patent: Oct. 24, 2023

(54) DISPLAY PANEL, DISPLAY MODULE, AND DISPLAY DEVICE

(71) Applicant: HKC CORPORATION LIMITED, Guangdong (CN)

(72) Inventors: Renjie Zhou, Guangdong (CN); Rongrong Li, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/330,939

(22) Filed: Jun. 7, 2023

(30) Foreign Application Priority Data

Oct. 9, 2022 (CN) ..... 202211228292.5

(51) Int. Cl.
*G09G 3/3258* (2016.01)

(52) U.S. Cl.
CPC ... *G09G 3/3258* (2013.01); *G09G 2300/0852* (2013.01); *G09G 2310/0256* (2013.01); *G09G 2310/08* (2013.01); *G09G 2320/045* (2013.01); *G09G 2330/028* (2013.01)

(58) Field of Classification Search
CPC ..... G09G 2300/0823; G09G 2310/0254
See application file for complete search history.

(56) References Cited

U.S. PATENT DOCUMENTS 11,138,925 B1 * 10/2021 Wang ..... G09G 3/32
11,289,023 B2 * 3/2022 Zhang ..... G09G 3/3258
2007/0164938 A1 * 7/2007 Shin ..... G09G 3/3291 345/76
2007/0229417 A1 * 10/2007 Giraldo ..... G09G 3/3233 345/82
2008/0136750 A1 6/2008 Benzarti et al.
2009/0166638 A1 * 7/2009 Honda ..... G09G 3/3233 257/E33.001

(Continued)

FOREIGN PATENT DOCUMENTS

CN 1655036 A 8/2005
CN 1797525 A 7/2006

(Continued)

OTHER PUBLICATIONS

The first office action issued in corresponding CN application No. 202211228292.5 dated Nov. 11, 2022.

(Continued)

*Primary Examiner* — Sepehr Azari
(74) *Attorney, Agent, or Firm* — HAUPTMAN HAM, LLP

(57) ABSTRACT

A display panel is provided in embodiments of the disclosure. The display panel includes multiple pixel units arranged in an array. During continuous display of two frames of images, each of the multiple pixel units is configured to receive a data signal of a first polarity to perform image display when a first frame of image in the two frames of images is displayed, and to receive a data signal of a second polarity to perform image display when a second frame of image in the two frames of images is displayed. Each of the multiple pixel units includes a first drive module, a second drive module, and a light-emitting module. The first drive module is configured to receive the data signal of the first polarity and to control the light-emitting module to emit light according to the data signal of the first polarity.

17 Claims, 4 Drawing Sheets

(56) References Cited

U.S. PATENT DOCUMENTS

| | | | | |
|---|---|---|---|---|
| 2010/0085282 | A1* | 4/2010 | Yu | G09G 3/3233 345/76 |
| 2011/0057919 | A1* | 3/2011 | Kim | G09G 3/3233 345/82 |
| 2012/0188150 | A1* | 7/2012 | Shirouzu | G09G 3/3233 345/76 |
| 2016/0117991 | A1 | 4/2016 | Ha | |
| 2017/0263184 | A1* | 9/2017 | Chen | G09G 3/3291 |
| 2020/0327852 | A1* | 10/2020 | Ji | G09G 3/3233 |

FOREIGN PATENT DOCUMENTS

| | | | |
|---|---|---|---|
| CN | 101937647 | A | 1/2011 |
| CN | 107123396 | A | 9/2017 |
| CN | 109215577 | A | 1/2019 |
| CN | 111273495 | A | 6/2020 |
| CN | 111627375 | A | 9/2020 |
| CN | 111899684 | A | 11/2020 |
| KR | 20210078785 | A | 6/2021 |

OTHER PUBLICATIONS

WIPO, International Search Report and Written Opinion for International Application No. PCT/CN2023/094770, dated Jun. 30, 2023.

* cited by examiner

DISPLAY PANEL, DISPLAY MODULE, AND DISPLAY DEVICE

CROSS-REFERENCE TO RELATED APPLICATION(S)

This application claims priority under 35 U.S.C. § 119(a) to Chinese Patent Application Serial No. 202211228292.5, filed Oct. 9, 2022, the entire disclosures of which is incorporated herein by reference.

TECHNICAL FIELD

The disclosure relates to the field of display technologies, and in particular, to a display panel, a display module, and a display device.

BACKGROUND

Organic Light-Emitting Diode (OLED) display devices have advantages of self-illumination, low drive voltage, high light-emitting efficiency, quick response, high clarity and high contrast, a viewing angle proximate to 180 degrees, a wide operating temperature range, flexible displays, large-area full-color displays, etc., and thus are considered to be the most promising display devices in the industry.

Currently, in a display panel, OLEDs are generally driven by direct current (DC) signals of the same polarity. However, the DC signals of the same polarity may cause continuous operation of Thin-Film Transistors (TFTs) in a pixel unit, which causes long operating time and continuous heat generation of the TFTs, and further shortens the service life of the TFTs.

SUMMARY

In view of the above disadvantages in the related art, a display panel, a display module, and a display device driven by an alternating current are provided in the disclosure.

A display panel includes multiple pixel units arranged in an array, and the multiple pixel units are configured to receive data signals for image display. During continuous display of two frames of images, each of the multiple pixel units is configured to receive a data signal of a first polarity to perform image display when an $N^{th}$ frame of image in the two frames of images is displayed, and to receive a data signal of a second polarity to perform image display when an $(N+1)^{th}$ frame of image in the two frames of images is displayed, where the first polarity is opposite to the second polarity, and N is an integer greater than or equal to zero. Each of the multiple pixel units includes a first drive module, a second drive module, and a light-emitting module. The first drive module is electrically connected to the light-emitting module and the second drive module is electrically connected to the light-emitting module, and the first drive module is configured to receive the data signal of the first polarity and to control the light-emitting module to emit light according to the data signal of the first polarity. The second drive module is configured to receive the data signal of the second polarity and to control the light-emitting module to emit light according to the data signal of the second polarity.

Optionally, the display panel further includes multiple scan lines extending in a first direction and multiple data lines extending in a second direction. The first direction is perpendicular to the second direction, and the multiple pixel units are respectively located at intersections between the multiple scan lines and the multiple data lines. Each of the multiple pixel units further includes a signal transmission module that is connected to the data line, the scan line, the first drive module, and the second drive module. The signal transmission module is configured to receive the data signal of the first polarity and the data signal of the second polarity from the data line, and to transfer the data signal of the first polarity to the first drive module and transfer the data signal of the second polarity to the second drive module.

Optionally, the first drive module is connected to a power supply voltage, and configured to control, upon receiving the data signal of the first polarity, the power supply voltage to be in electrical conduction with the light-emitting module according to the data signal of the first polarity, to drive the light-emitting module to emit light. The second drive module is connected to the power supply voltage, and configured to control, upon receiving the data signal of the second polarity, the power supply voltage to be electrical conduction with the light-emitting module according to the data signal of the second polarity, to drive the light-emitting module to emit light.

Optionally, the first drive module includes a first voltage-stabilizing unit and a first drive unit. The first voltage-stabilizing unit is connected to the signal transmission module and the light-emitting module, and is configured to receive and store the data signal of the first polarity from the signal transmission module, and to apply a stable voltage to the light-emitting module during light emission of the light-emitting module. The first drive unit is connected to the signal transmission module, the power supply voltage, and the light-emitting module, and configured to receive the data signal of the first polarity from the signal transmission module, and to control the power supply voltage to be in electrical conduction with the light-emitting module according to the data signal of the first polarity, to control the light-emitting module to emit light.

Optionally, the second drive module includes a second voltage-stabilizing unit and a second drive unit. The second voltage-stabilizing unit is connected to the signal transmission module and the power supply voltage, and is configured to receive and store the data signal of the second polarity from the signal transmission module, and to apply a stable voltage to the light-emitting module during the light emission of the light-emitting module. The second drive unit is connected to the signal transmission module, the power supply voltage, and the light-emitting module, and configured to receive the data signal of the second polarity from the signal transmission module, and to control the power supply voltage to be in electrical conduction with the light-emitting module according to the data signal of the second polarity, to control the light-emitting module to emit light.

Optionally, the signal transmission module includes a first transistor, a gate of the first transistor is connected to the scan line, and a source of the first transistor is connected to the data line. When the first transistor receives a scan signal from the scan line through the gate of the first transistor, the source of the first transistor is in conduction with the drain of the first transistor, and the first transistor receives the data signal of the first polarity or the data signal of the second polarity from the data line.

Optionally, the first voltage-stabilizing unit includes a second transistor and a first capacitor, and the first drive unit includes a third transistor. A gate of the second transistor is connected to the source of the first transistor, a source of the second transistor is connected to the drain of the first transistor, and the drain of the first transistor is connected to the first capacitor. When the second transistor receives the data signal of the first polarity through the gate of the second transistor, the source of the second transistor is in electrical conduction with the drain of the second transistor, and the second transistor receives the data signal of the first polarity from the drain of the first transistor. One end of the first capacitor is connected to the drain of the second transistor, another end of the first capacitor is connected to the light-emitting module, and the first capacitor is configured to receive the data signal of the first polarity from the drain of the second transistor and to apply a stable voltage to the light-emitting module. A gate of the third transistor is connected to the drain of the first transistor, a source of the third transistor is connected to the power supply voltage, and a drain of the third transistor is connected to the light-emitting module. When the third transistor receives the data signal of the first polarity through the gate of the third transistor, the source of the third transistor is in conduction with the drain of the third transistor to control the power supply voltage to be in electrical conduction with the light-emitting module.

Optionally, the second voltage-stabilizing unit includes a fourth transistor and a second capacitor, and the second drive unit includes a fifth transistor. A gate of the fourth transistor is connected to the source of the first transistor, a source of the fourth transistor is connected to the drain of the first transistor, and a drain of the fourth transistor is connected to the second capacitor. When the fourth transistor receives the data signal of the second polarity through the gate of the fourth transistor, the source of the fourth transistor is in electrical conduction with the drain of the fourth transistor, and the fourth transistor receives the data signal of the second polarity from the drain of the first transistor. One end of the second capacitor is connected to the drain of the fourth transistor, and another end of the second capacitor is connected to the power supply voltage. When the source of the fourth transistor is in conduction with the drain of the fourth transistor, the second capacitor is charged with the power supply voltage. A gate of the fifth transistor is connected to the drain of the first transistor, a source of the fifth transistor is connected to the power supply voltage, and a drain of the fifth transistor is connected to the light-emitting module. When the fifth transistor receives the data signal of the second polarity from the drain of the first transistor through the gate of the fifth transistor, the source of the fifth transistor in conduction with the drain of the fifth transistor to control the power supply voltage to be in electrical conduction with the light-emitting module.

A display module is further provided in the disclosure. The display module includes a data drive circuit, a display control circuit, a light-emitting controller, and the above-mentioned display panel. The data drive circuit is configured to receive a source output control signal from the display control circuit and to output the data signals according to the source output signal. A scan drive circuit in a non-display region of the display panel is configured to receive a gate output control signal from the display control circuit and to output scan signals according to the gate output control signal. The multiple pixel units in the display panel are configured to perform image display according to the scan signals and the data signals under the control of the light-emitting controller.

A display device is provided the disclosure. The display device includes a support frame, a power supply module, and the above-mentioned display module. The power supply module is configured to apply a power supply voltage to the display panel to perform image display, and the display module and the power supply module are fixed to the support frame.

Compared with the related art, with two types of transistors with opposite polarities, in the pixel unit, light emitting diodes are controlled for light emission under the driving of data signals of two polarities. Thus, continuous operating time of the two types of transistors is reduced, the heat generation of the two types of transistors is reduced, and the service life of the pixel unit is prolonged. Meanwhile, due to the intermittent operation of the transistor, the influence of a drift of a threshold voltage Vth of the transistor is reduced, improving the display effect.

BRIEF DESCRIPTION OF THE DRAWINGS

To describe technical solutions in embodiments of the disclosure more clearly, the following briefly introduces the accompanying drawings required for describing the embodiments. Apparently, the accompanying drawings in the following description only illustrate some embodiments of the disclosure. Those of ordinary skill in the art may also obtain other drawings based on these accompanying drawings without creative efforts.

Figure 1:
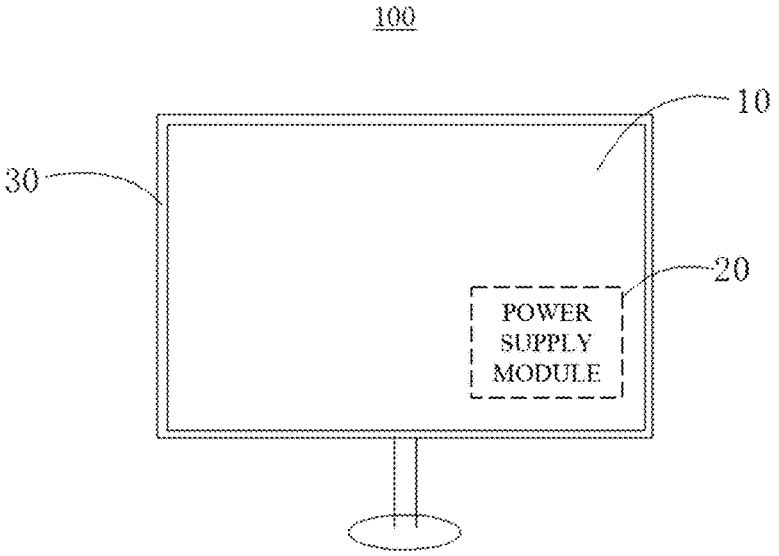
FIG. 1 is a schematic structural diagram of a display device provided in an embodiment of the disclosure.

Reference numbers are described as follows:

display device—100; display module—10; power supply module—20; support frame—30; data drive circuit—11; scan drive circuit—12; display panel—13; display region—13*a*; display control circuit—14; pixel unit—15; light-emitting controller—16; first direction—X; second direction—Y; clock signal—CLK; data line—S; scan line—G; data signal—Data; horizontal synchronizing signal—Hsyn; vertical synchronizing signal—Vsyn; gate output control signal—Cg; source output control signal—Cs; data signal of first polarity—Data+; data signal of the second polarity—Data-; first frame of image—F1; second frame of image—F2; common voltage—Vcom; signal transmission module—150; first drive module—151; second drive module—152; light-emitting module—153; first voltage-stabilizing unit —151A; first drive unit—151B; second voltage-stabilizing unit—152A; second drive unit—152B; first transistor—T1; second transistor—T2; third transistor—T3; fourth transistor—T4; fifth transistor—T5; first capacitor—C1; second capacitor—C2; analog power supply voltage—AVDD; power supply voltage—Vdd; low voltage end—Vss.

DETAILED DESCRIPTION

For ease understanding of the disclosure, the disclosure is described more completely with reference to the accompanying drawings hereinafter. The accompanying drawings illustrate preferred embodiments of the disclosure. However, the disclosure can be implemented in various forms and is not limited to the embodiments described herein. Rather, these embodiments are provided for a more thorough and comprehensive understanding of the disclosure.

The following embodiments are described with reference to the accompanying drawings to exemplify particular embodiments that may be implemented by the disclosure. The serial numbers themselves, such as "first" and "second" are used herein to distinguish the objects described, and do not have any sequential or technical meaning. The terms "connection" and "coupling" in the disclosure include direct and indirect connections (couplings), unless otherwise specified. Directional terms such as "up", "down", "front", "back", "left", "right", "inside", "outside", "side", and the like referred to herein which are only for directions with reference to the accompanying drawings. Therefore, the directional terms used herein are intended to better and more clearly illustrate and understand the disclosure, rather than explicitly or implicitly indicate that apparatus or components referred to herein must have a certain direction or be configured or operated in a certain direction and therefore cannot be understood as limitation on the disclosure.

It is noted that, in the description of the disclosure, terms "install", "couple", "connect", and "interconnect" should be understood in a broad sense unless otherwise expressly specified and limited. For example, the terms "install", "couple", "connect", and "interconnect" may refer to fixedly connect, detachably connect, or integrally connect, may refer to mechanically connect, and may refer to a directly connect, indirectly connect through an intermediate medium, or an intercommunicate interiors of two elements. For those of ordinary skill in the art, the specific meanings of the above terms in the disclosure can be understood according to specific situations. It is noted that, the terms such as "first" and "second" in the specification, claims, and the accompanying drawings of the disclosure are used for distinguishing between different objects rather than describing a particular order.

In addition, terms such as "include", "may include", "contain", or "may contain" used herein indicate the existence of the corresponding function, operation, element, etc. disclosed, and do not limit the other one or more further functions, operations, elements, etc. In addition, the term "include" or "contain" indicates the existence of the corresponding feature, number, step, operation, element, component, or combination thereof disclosed in the specification, without excluding the existence or addition of one or more other features, numbers, steps, operations, elements, components, or combinations thereof, and is intended to cover non-exclusive inclusion. In addition, when describing the embodiments of the disclosure, the term "may" is used to denote "one or more embodiments of the disclosure". Also, the term "exemplary" is intended to refer to examples or illustrations.

Unless otherwise defined, all technical and scientific terms used herein have the same meaning as commonly understood by those skilled in the art of the disclosure. The terms used herein in the disclosure are for merely describing embodiments rather than intending to limit the disclosure.

Referring to FIG. 1, FIG. 1 is a schematic structural diagram of a display device 100 provided in a first embodiment of the disclosure. The display device 100 includes a display module 10, a power supply module 20, and a support frame 30. The display module 10 and the power supply module 20 are fixed to the support frame 30. The power supply module 20 is disposed at a back face of the display module 10 (i.e., a non-display face of the display module 10). The power supply module 20 is configured to apply a power supply voltage to the display module 10 for image display. The support frame 30 fixes and protects the display module 10 and the power supply module 20.

Figure 2:
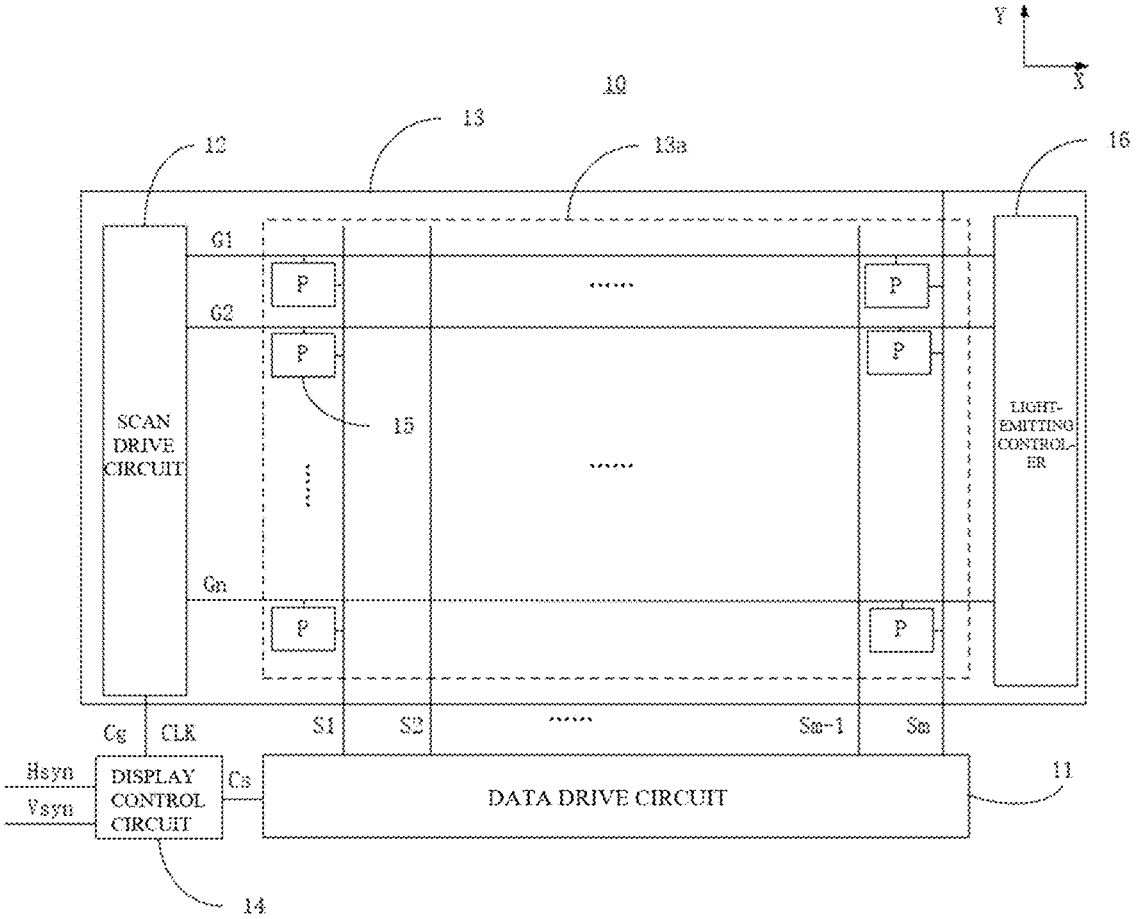
FIG. 2 is a schematic diagram illustrating a planar layout structure of a display module in FIG. 1.

Referring to FIG. 2, FIG. 2 is a schematic diagram illustrating a planar layout structure of the display module 10 in FIG. 1.

As illustrated in FIG. 2, the display module 10 includes a data drive circuit 11, a scan drive circuit 12, a display panel 13, a display control circuit 14, and a light-emitting controller 16. The data drive circuit 11, the scan drive circuit 12, the display control circuit 14, and the light-emitting controller 16 are disposed at a non-display region of the display panel 13.

In a display region 13*a* of the display panel 13, multiple data lines S1-Sm and multiple gate lines G1-Gn are arranged in a grid pattern. The multiple scan lines G1-Gn extend in a first direction X, the multiple data lines S1-Sm extend in a second direction Y, and the first direction X is perpendicular to the second direction Y.

Multiple pixel units 15 are respectively located at intersections between the multiple scan lines G1-Gn and the multiple data lines S1-Sm. The scan lines G1-Gn are connected to the scan drive circuit 12, and configured to receive scan signals from the scan drive circuit 12. The data lines S1-Sm are connected to the data drive circuit 11, and configured to receive data signals Data from the data drive circuit 11, where the data signals Data are stored and transferred in the form of a grayscale value.

Each of the pixel units 15 receives, in a predetermined time period under the control of a corresponding scan line in the scan lines G1-Gn, a data voltage corresponding to a data signals Data in the form of a grayscale value provided by a corresponding data line in the data lines S1-Sm, to perform image display.

The display control circuit 14 is configured to receive, from an external signal source, an image signal representing image information, a clock signal CLK for synchronization, a horizontal synchronizing signal Hsyn, and a vertical synchronizing signal Vsyn, and to output a gate output control signal Cg to the scan drive circuit 12, and a source output control signal Cs and the data signal Data representing image information to the data drive circuit 11. In the embodiment, the display control circuit 14 is configured to adjust original data signals to obtain the data signals Data, and to transfer the data signals Data to the data drive circuit 11.

The scan drive circuit 12 is configured to receive the gate output control signal Cg outputted by the display control circuit 14, and to output the scan signals to the scan lines G1-Gn, respectively. The data drive circuit 11 is configured to receive the source output control signal Cs outputted by the display control circuit 14 and to output the data signal Data to each of the data lines S1-Sm, where the data signal Data is utilized by a drive element of each pixel unit 15 in the display region 13*a* for image display. The data signal Data outputted to the display panel 13 is an analog grayscale voltage. The scan drive circuit 12 is configured to output the scan signal to control the pixel unit 15 to receive the data signal Data outputted by the data drive circuit 11. The light-emitting controller 16 is configured to output light-emitting signals to the multiple pixel units 15 to control light emission of the multiple pixel units 15, so that the multiple pixel units 15 can be controlled to perform image display.

Figure 3:
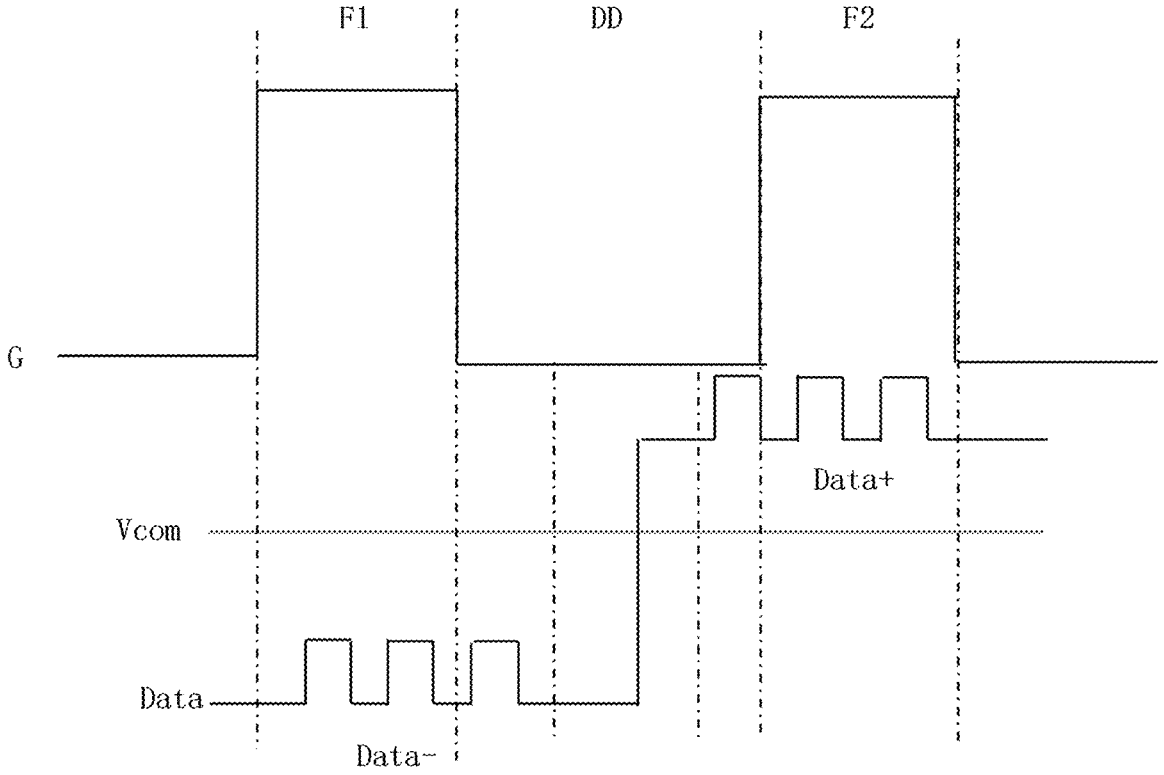
FIG. 3 is a diagram illustrating output timing of a data signal and a scan signal in FIG. 2.

Referring to FIG. 3, FIG. 3 is a diagram illustrating output timing of a data signal and a scan signal in FIG. 2.

As illustrated in FIG. 3, in the display panel 13, for each of the pixel units 15 connected to the same data line S, during continuous display of two frames of images, the pixel unit 15 is configured to receive a data signal Data+ of a first polarity to perform image display when a $N^{th}$ frame of image in the two frames of images is displayed, and to receive a data signal Data− of a second polarity to perform image display when a $(N+1)^{th}$ frame of image in the two frames of images is displayed. For example, the pixel unit 15 is configured to receive the data signal Data+ of the first polarity to perform image display when a first frame of image in the two frames of images is displayed, and to receive the data signal Data− of the second polarity to perform image display when a second frame of image in the two frames of images is displayed. Alternatively, the pixel unit 15 is configured to receive the data signal Data− of the second polarity to perform image display when the first frame of image in the two frames of images is displayed, and to receive the data signal Data+ of the first polarity to perform image display when the second frame of image in the two frames of images is displayed. In other words, the pixel unit 15 is configured to display a $N^{th}$ frame of image in the two frames of images upon receiving a data signal Data+ of a first polarity, and to display a $(N+1)^{th}$ frame of image in the two frames of images upon receiving a data signal Data− of a second polarity. For example, the pixel unit 15 is configured to display a first frame of image in the two frames of images upon receiving the data signal Data+ of the first polarity, and to display a second frame of image in the two frames of images upon receiving the data signal Data− of the second polarity. Alternatively, the pixel units 15 is configured to display the first frame of image in the two frames of images upon receiving the data signal Data− of the second polarity, and to display the second frame of image in the two frames of images upon receiving the data signal Data+ of the first polarity. The data signal Data+ of the first polarity is a data signal of a positive polarity, and the data signal Data− of the second polarity is a data signal of a negative polarity. Alternatively, the data signal Data+ of the first polarity is a data signal of a negative polarity, and the data signal Data− of the second polarity is a data signal of a positive polarity.

A polarity of a data signal transferred through the data line is reversed during a time period between display periods of two frames of images. In a case where the first frame of image is displayed under driving of the data signal Data+ of the first polarity, when polarity reversing is performed, the second frame of image is displayed under driving of the data signal Data− of the second polarity. In a case where the first frame of image is displayed under driving of the data signal Data− of the second polarity, when polarity reversing is performed, the second frame of image is displayed under driving of the data signal Data+ of the first polarity. A voltage value of the data signal Data+ of the first polarity is greater than that of a common voltage Vcom, and a voltage value of the data signal Data− of the second polarity is less than that of the common voltage Vcom.

For example, when the display panel 13 displays the first frame of image F1, among pixel units 15 in multiple columns that are connected to the multiple data lines S1-Sm, each of pixel units 15 in odd columns receives a data signal Data− of the second polarity through a data line connected thereto, and each of pixel units 15 in even columns receives a data signal Data+ of the first polarity through a data line connected thereto.

In a display-transition time period DD, for each data signal, the data drive circuit 11 controls the data line to transfer a data signal with a polarity opposite a polarity of a data signal previously transferred through the data line, so that a data line that previously transferred the data signal Data− of the second polarity can currently transfer the data signal Data+ of the first polarity, and a data line that previously transferred the data signal Data+ of the first polarity can currently transfer the data signal Data− of the second polarity.

When the display panel 13 displays the second frame of image F2, each of the pixel units 15 in the odd columns receives the data signal Data+ of the first polarity through a data line connected thereto, and each of the pixel units 15 in the even columns receives the data signal Data− of the second polarity through a data line connected thereto.

Each of the pixel units 15 is driven for image display by data signals with opposite polarities, that is, each of the pixel units 15 is driven for image display by an alternating current.

The data drive circuit 11 includes two analog power supply voltages AVDD, which are respectively configured to output the data signal Data+ of the first polarity and the data signal Data− of the second polarity. With the two analog power supply voltages AVDD, a load of each analog power supply voltage AVDD is reduced by half, thereby reducing a heating quantity of each data drive circuit 11 by half.

Figure 4:
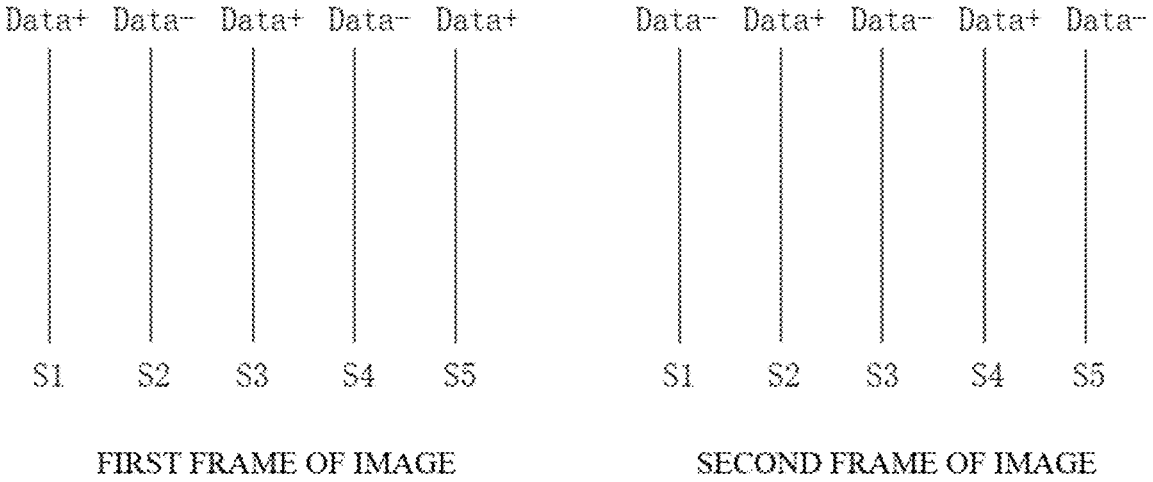
FIG. 4 is a schematic diagram illustrating changes of data signals transferred through multiple data lines of a display panel in FIG. 2.

Referring to FIG. 4, FIG. 4 is a schematic diagram illustrating changes of data signals transferred through multiple data lines of the display panel in FIG. 2.

As illustrated in FIG. 4, in the multiple data lines S1-Sm, data signals transferred through two adjacent data lines have opposite polarities.

For example, during display of the first frame of image, a first data line S1 transfers a data signal Data+ of the first polarity, a second data line S2 transfers a data signal Data− of the second polarity, and a third data line S3 transfers a data signal Data− of the second polarity. During display of the second frame of image, the first data line S1 transfers a data signal Data− of the second polarity, the second data line S2 transfers a data signal Data+ of the first polarity, and the third data line S3 transfers a data signal Data− of the second polarity. A polarity of a data signal transferred through the first data line S1 during display of the first frame of image is opposite to a polarity of a data signal transferred through the first data line S1 during display of the second frame of image, a polarity of a data signal transferred through the second data line S2 during display of the first frame of image is opposite to a polarity of a data signal transferred through the second data line S2 during display of the second frame of image, and a polarity of a data signal transferred through the third data line S3 during display of the first frame of image is opposite to a polarity of a data signal transferred through the third data line S3 during display of the second frame of image.

Figure 5:
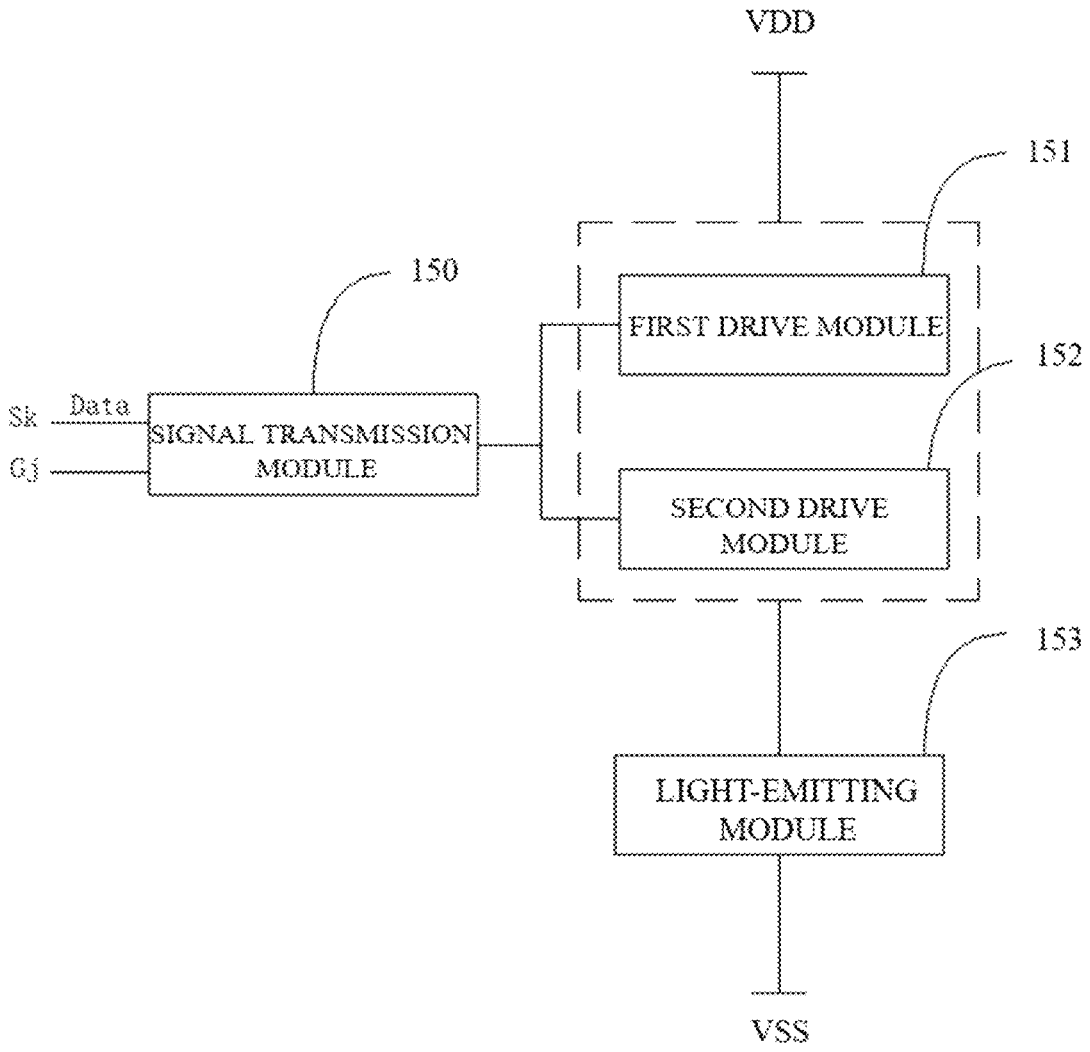
FIG. 5 is a schematic block diagram of a pixel unit in FIG. 2.

Referring to FIG. 5, FIG. 5 is a schematic block diagram of the pixel unit in FIG. 2. As illustrated in FIG. 5, the pixel unit 15 includes a signal transmission module 150, a first drive module 151, a second drive module 152, and a light-emitting module 153. The signal transmission module 150 is connected to a $k^{th}$ data line Sk ($1 \le k \le m$) and a $j^{th}$ scan line Gj ($1 \le j \le n$), and is configured to receive the data signal Data+ of the first polarity or the data signal Data− of the second polarity through the $k^{th}$ data line Sk under the control of the scan signal.

The first drive module 151 and the second drive module 152 are electrically connected to the signal transmission module 150 respectively. The first drive module 151 is configured to receive the data signal Data+ of the first polarity from the signal transmission module 150, and the second drive module 152 is configured to receive the data signal Data− of the second polarity from the signal transmission module 150. The first drive module 151 and the second drive module 152 are respectively connected to a power supply voltage Vdd, and are connected to a low voltage end Vss through the light-emitting module 153. When the first drive module 151 receives the data signal Data+ of the first polarity, the first drive module 151 is in electrical conduction with the light-emitting module 153 to control the light-emitting module 153 to emit light. When the second drive module 152 receives the data signal Data− of the second polarity, the second drive module 152 is in electrically conduction with the light-emitting module 153 to control the light-emitting module 153 to emit light.

Figure 6:
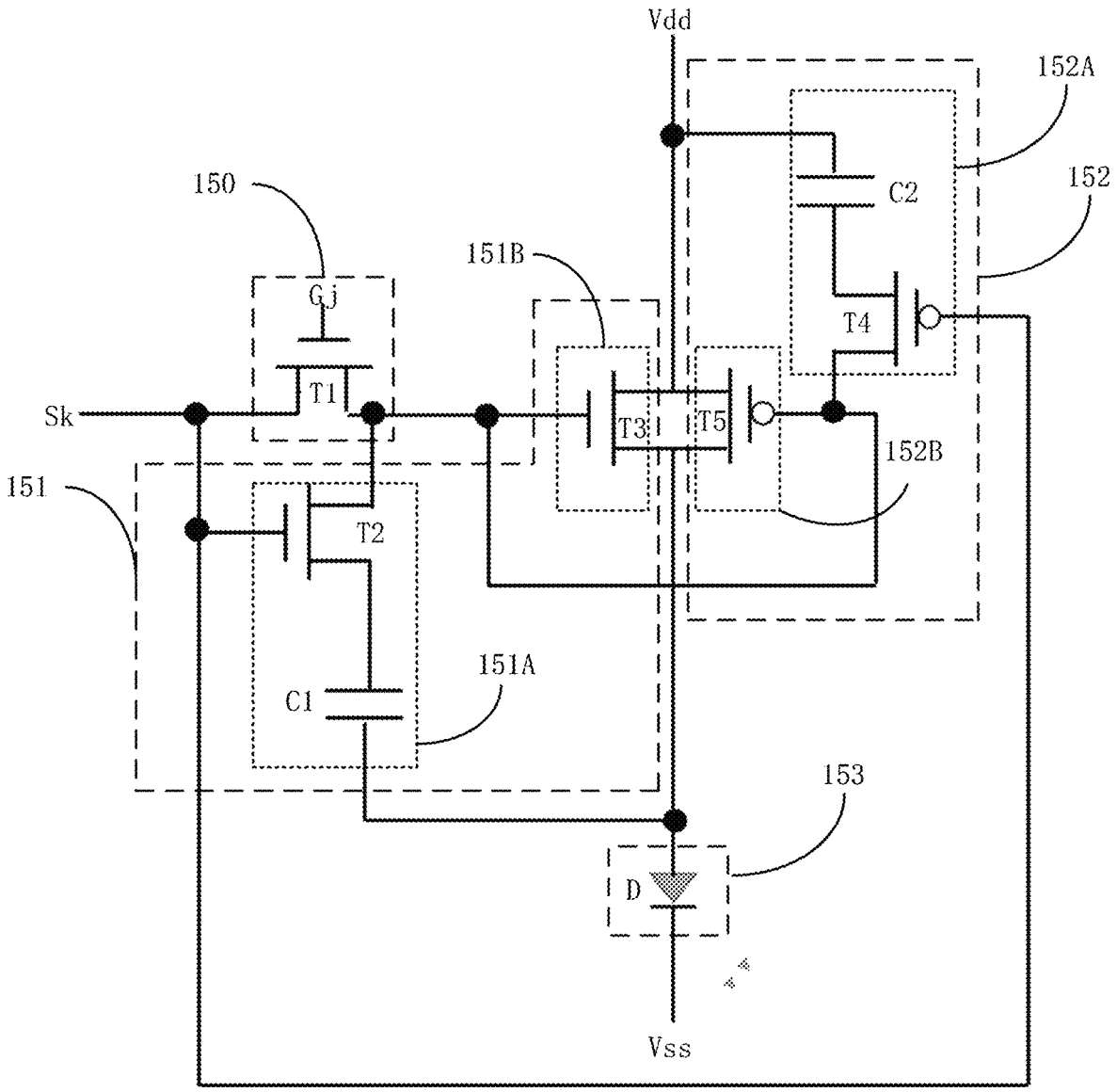
FIG. 6 is an equivalent circuit diagram of the pixel unit in FIG. 5.

Referring to FIG. 6, FIG. 6 is an equivalent circuit diagram of the pixel unit in FIG. 5.

As illustrated in FIG. 6, the first drive module 151 includes a first voltage-stabilizing unit 151A and a first drive unit 151B. The first voltage-stabilizing unit 151A is connected between the signal transmission module 150 and the light-emitting module 153, and is configured to receive and store the data signal Data+ of the first polarity from the signal transmission module 150, and to provide a stable voltage for the light-emitting module 153 during light emission of the light-emitting module 153. The first drive unit 151B is connected to the signal transmission module 150, the power supply voltage Vdd, and the light-emitting module 153, and is configured to receive the data signal Data+ of the first polarity from the signal transmission module 150, and to control, according to the data signal, the power supply voltage Vdd to be in electrical conduction with the light-emitting module 153 to control the light-emitting module 153 to emit light.

The second drive module 152 includes a second voltage-stabilizing unit 152A and a second drive unit 152B. The second voltage-stabilizing unit 152A is connected between the signal transmission module 150 and the power supply voltage Vdd, and is configured to receive and store the data signal Data− of the second polarity from the signal transmission module 150. The second drive unit 152B is connected to the signal transmission module 150, a power supply voltage Vdd, and the light-emitting module 153, and is configured to receive the data signal Data− of the second polarity from the signal transmission module 150, and to control the power supply voltage Vdd to be in electrical conduction with the light-emitting module 153 to control the light-emitting module 153 to emit light.

Specifically, the signal transmission module 150 includes a first transistor T1, the first voltage-stabilizing unit 151A includes a second transistor T2 and a first capacitor C1, and the first drive unit 151B includes a third transistor T3.

A gate of the first transistor T1 is connected to the $j^{th}$ scan line Gj, the first transistor T1 is configured to receive a scan signal through the $j^{th}$ scan line Gj, and a source of the first transistor T1 and a drain of the first transistor T1 are controlled to be in conduction according to the scan signal. The source of the first transistor T1 is connected to the $k^{th}$ data line Sk for receiving a data signal Data− of the positive polarity or a data signal Data− of the second polarity through the $k^{th}$ data line Sk. The drain of the first transistor T1 is connected to the second transistor T2 and the third transistor T3 for outputting the data signal Data+ of the first polarity to the second transistor T2 and the third transistor T3.

A gate of the second transistor T2 is connected to a source of the first transistor T1, the second transistor T2 is configured to receive the data signal Data+ of the first polarity through the $k^{th}$ data line SK, and a source of the second transistor T2 and a drain of the second transistor T2 are controlled to be in conduction according to the data signal Data+ of the first polarity. The source of the second transistor T2 is connected to the drain of the first transistor T1, the drain of the second transistor T2 is connected to the first capacitor C1, and the second transistor T2 is configured to receive the data signal Data+ of the first polarity through the drain of the first transistor T1 and to transfer the data signal Data+ of the first polarity to the first capacitor C1 for charging the first capacitor C1. Another end of the first capacitor C1 is connected to the light-emitting module 153 for providing a stable current for the light-emitting module 153.

A gate of the third transistor T3 is connected to the drain of the first transistor T1, and the third transistor T3 is configured to receive the data signal Data+ of the first polarity through the drain of the first transistor T1, and a source of the third transistor T3 and a drain of the third transistor T3 are controlled to be in conduction according to the data signal. The source of the third transistor T3 is connected to the power supply voltage Vdd, and the drain of the third transistor T3 is connected to the light-emitting module 153. When the gate of the third transistor T3 receives the data signal Data+ of the first polarity, the power supply voltage Vdd is controlled to be electrically connected to the light-emitting module 153 for controlling the light-emitting module 153 to emit light.

The second voltage-stabilizing unit 152A includes a fourth transistor T4 and a second capacitor C2, and the second drive unit 152B includes a fifth transistor T5. A gate of the fourth transistor T4 is connected to the $k^{th}$ data line Sk, and the fourth transistor T4 is configured to receive the data signal Data− of the second polarity through the $k^{th}$ data line Sk, and a source of the fourth transistor T4 and a drain of the fourth transistor T4 are controlled to be in conduction according to the data signal Data− of the second polarity. The source of the fourth transistor T4 is connected to the drain of the first transistor T1, the drain of the fourth transistor T4 is connected to the second capacitor C2, and another end of the second capacitor C2 is connected to the power supply voltage Vdd. When the gate of the fourth transistor T4 receives the data signal Data− of the second polarity, the source of the fourth transistor T4 and the drain of the fourth transistor T4 for charging the second capacitor C2. The second capacitor C2 is configured to provide a stable current for the light-emitting module 153 during light emission of the light-emitting module 153.

A gate of the fifth transistor T5 is connected to the drain of the first transistor T1, and the fifth transistor T5 is configured to receive the data signal Data of the second polarity through the drain of the first transistor T1, and a source of the fifth transistor T5 and a drain of the fifth transistor T5 are controlled to be in conduction according to the data signal Data− of the second polarity. The source of the fifth transistor T5 is connected to the power supply voltage Vdd, and the drain of the fifth transistor T5 is connected to the light-emitting module 153. When the source of the fifth transistor T5 is in condition with the drain of the fifth transistor T5, the light-emitting module 153 is electrically connected to the power supply voltage Vdd for light emission.

The first transistor T1, the second transistor T2, the third transistor T3, the fourth transistor T4, and the fifth transistor T5 are Thin-Film Transistors (TFTs). The first transistor T1, the second transistor T2, and the third transistor T3 are N-type Metal Oxide Semiconductor (MOS) transistors, and the fourth transistor T4 and the fifth transistor T5 are P-type MOS transistors.

The light-emitting module 153 includes an organic light-emitting diode D, an anode of the organic light-emitting diode D is connected to the drain of the third transistor T3, and a cathode of the organic light-emitting diode D is connected to the low voltage end Vss.

With two types of TFTs with opposite polarities (i.e. an N-type MOS transistor and a P-type MOS transistor), in the pixel unit, the two types of TFTs are alternately driven by data signals of two polarities for controlling light emission of a diode. Thus, the continuous operating time of the TFT is reduced, the heat generation of the TFT is reduced, and the service life of the pixel unit is prolonged. Meanwhile, due to the intermittent operation of the TFT, the influence of the drift of a threshold voltage Vth of the TFT is reduced, and the display effect is improved.

It should be understood that the application of the disclosure is not limited to the above examples, and those skilled in the art can make improvements or modifications according to the above descriptions, and all these improvements and modifications shall belong to the scope of protection of the appended claims of the present invention.

What is claimed is:

1. A display panel, comprising a plurality of pixel units arranged in an array, and the plurality of pixel units are configured to receive data signals for image display, wherein during continuous display of two frames of images, each of the plurality of pixel units is configured to receive a data signal of a first polarity to perform image display when an $N^{th}$ frame of image in the two frames of images is displayed, and to receive a data signal of a second polarity to perform image display when an $(N+1)^{th}$ frame of image in the two frames of images is displayed, wherein the first polarity is opposite to the second polarity, and N is an integer greater than or equal to zero;

each of the plurality of pixel units comprises a first drive module, a second drive module, and a light-emitting module, wherein the first drive module is electrically connected to the light-emitting module and the second drive module is electrically connected to the light-emitting module, and the first drive module is configured to receive the data signal of the first polarity and to control the light-emitting module to emit light according to the data signal of the first polarity;

the first drive module comprises a first voltage-stabilizing unit and a first drive unit, wherein the first voltage-stabilizing unit is connected to the light-emitting module, and is configured to receive and store the data signal of the first polarity, and to apply a stable voltage to the light-emitting module during light emission of the light-emitting module, and wherein the first drive unit is connected to a power supply voltage and the light-emitting module, and configured to control the power supply voltage to be in electrical conduction with the light-emitting module according to the data signal of the first polarity, to control the light-emitting module to emit light; and the second drive module is configured to receive the data signal of the second polarity and to control the light-emitting module to emit light according to the data signal of the second polarity, wherein each of the plurality of pixel units comprises a signal transmission module, and the signal transmission module comprises a first transistor, wherein the first voltage-stabilizing unit comprises a second transistor and a first capacitor, and the first drive unit comprises a third transistor;

a gate of the second transistor is connected to a source of the first transistor, a source of the second transistor is connected to a drain of the first transistor, and the drain of the first transistor is connected to the first capacitor, wherein when the second transistor receives the data signal of the first polarity through the gate of the second transistor, the source of the second transistor is in electrical conduction with the drain of the second transistor, and the second transistor receives the data signal of the first polarity from the drain of the first transistor;

one end of the first capacitor is connected to the drain of the second transistor, another end of the first capacitor is connected to the light-emitting module, and the first capacitor is configured to receive the data signal of the first polarity from the drain of the second transistor and to apply a stable voltage to the light-emitting module; and a gate of the third transistor is connected to the drain of the first transistor, a source of the third transistor is connected to the power supply voltage, and a drain of the third transistor is connected to the light-emitting module, wherein when the third transistor receives the data signal of the first polarity through the gate of the third transistor, the source of the third transistor is in conduction with the drain of the third transistor to control the power supply voltage to be in electrical conduction with the light-emitting module.

2. The display panel of claim 1, further comprising a plurality of scan lines extending in a first direction and a plurality of data lines extending in a second direction, wherein the first direction is perpendicular to the second direction, and the plurality of pixel units are respectively located at intersections between the plurality of scan lines and the plurality of data lines; wherein the signal transmission module is connected to the data line, the scan line, the first drive module, and the second drive module, wherein the signal transmission module is configured to receive the data signal of the first polarity and the data signal of the second polarity from the data line, and to transfer the data signal of the first polarity to the first drive module and transfer the data signal of the second polarity to the second drive module.

3. The display panel of claim 2, wherein the second drive module is connected to the power supply voltage, and configured to control, upon receiving the data signal of the second polarity, the power supply voltage to be electrical conduction with the light-emitting module according to the data signal of the second polarity, to drive the light-emitting module to emit light.

4. The display panel of claim 3, wherein the second drive module comprises a second voltage-stabilizing unit and a second drive unit, wherein the second voltage-stabilizing unit is connected to the signal transmission module and the power supply voltage, and is configured to receive and store the data signal of the second polarity from the signal transmission module, and to apply a stable voltage to the light-emitting module during the light emission of the light-emitting module; and the second drive unit is connected to the signal transmission module, the power supply voltage, and the light-emitting module, and configured to receive the data signal of the second polarity from the signal transmission module, and to control the power supply voltage to be in electrical conduction with the light-emitting module according to the data signal of the second polarity, to control the light-emitting module to emit light.

5. The display panel of claim 4, wherein a gate of the first transistor is connected to the scan line, and the source of the first transistor is connected to the data line, wherein when the first transistor receives a scan signal from the scan line through the gate of the first transistor, the source of the first transistor is in conduction with the drain of the first transistor, and the first transistor receives the data signal of the first polarity or the data signal of the second polarity from the data line.

6. The display panel of claim 5, wherein the second voltage-stabilizing unit comprises a fourth transistor and a second capacitor, and the second drive unit comprises a fifth transistor;

a gate of the fourth transistor is connected to the source of the first transistor, a source of the fourth transistor is connected to the drain of the first transistor, and a drain of the fourth transistor is connected to the second capacitor, wherein when the fourth transistor receives the data signal of the second polarity through the gate of the fourth transistor, the source of the fourth transistor is in electrical conduction with the drain of the fourth transistor, and the fourth transistor receives the data signal of the second polarity from the drain of the first transistor;

one end of the second capacitor is connected to the drain of the fourth transistor, and another end of the second capacitor is connected to the power supply voltage, wherein when the source of the fourth transistor is in conduction with the drain of the fourth transistor, the second capacitor is charged with the power supply voltage; and a gate of the fifth transistor is connected to the drain of the first transistor, a source of the fifth transistor is connected to the power supply voltage, and a drain of the fifth transistor is connected to the light-emitting module, wherein when the fifth transistor receives the data signal of the second polarity from the drain of the first transistor through the gate of the fifth transistor, the source of the fifth transistor in conduction with the drain of the fifth transistor to control the power supply voltage to be in electrical conduction with the light-emitting module.

7. A display module, comprising a data drive circuit, a display control circuit, a light-emitting controller, and a display panel comprising a plurality of pixel units arranged in an array, and the plurality of pixel units are configured to receive data signals for image display, wherein during continuous display of two frames of images, each of the plurality of pixel units is configured to receive a data signal of a first polarity to perform image display when an $N^{th}$ frame of image in the two frames of images is displayed, and to receive a data signal of a second polarity to perform image display when an $(N+1)^{th}$ frame of image in the two frames of images is displayed, wherein the first polarity is opposite to the second polarity, and N is an integer greater than or equal to zero;

each of the plurality of pixel units comprises a first drive module, a second drive module, and a light-emitting module, wherein the first drive module is electrically connected to the light-emitting module and the second drive module is electrically connected to the light-emitting module, and the first drive module is configured to receive the data signal of the first polarity and to control the light-emitting module to emit light according to the data signal of the first polarity;

the first drive module comprises a first voltage-stabilizing unit and a first drive unit, wherein the first voltage-stabilizing unit is connected to the light-emitting module, and is configured to receive and store the data signal of the first polarity, and to apply a stable voltage to the light-emitting module during light emission of the light-emitting module, and wherein the first drive unit is connected to a power supply voltage and the light-emitting module, and configured to control the power supply voltage to be in electrical conduction with the light-emitting module according to the data signal of the first polarity, to control the light-emitting module to emit light;

the second drive module is configured to receive the data signal of the second polarity and to control the light-emitting module to emit light according to the data signal of the second polarity; and the data drive circuit is configured to receive a source output control signal from the display control circuit and to output the data signals according to the source output signal, a scan drive circuit in a non-display region of the display panel is configured to receive a gate output control signal from the display control circuit and to output scan signals according to the gate output control signal, the plurality of pixel units in the display panel are configured to perform image display according to the scan signals and the data signals under the control of the light-emitting controller, wherein each of the plurality of pixel units comprises a signal transmission module, and the signal transmission module comprises a first transistor, wherein the first voltage-stabilizing unit comprises a second transistor and a first capacitor, and the first drive unit comprises a third transistor;

a gate of the second transistor is connected to a source of the first transistor, a source of the second transistor is connected to a drain of the first transistor, and the drain of the first transistor is connected to the first capacitor, wherein when the second transistor receives the data signal of the first polarity through the gate of the second transistor, the source of the second transistor is in electrical conduction with the drain of the second transistor, and the second transistor receives the data signal of the first polarity from the drain of the first transistor;

one end of the first capacitor is connected to the drain of the second transistor, another end of the first capacitor is connected to the light-emitting module, and the first capacitor is configured to receive the data signal of the first polarity from the drain of the second transistor and to apply a stable voltage to the light-emitting module; and a gate of the third transistor is connected to the drain of the first transistor, a source of the third transistor is connected to the power supply voltage, and a drain of the third transistor is connected to the light-emitting module, wherein when the third transistor receives the data signal of the first polarity through the gate of the third transistor, the source of the third transistor is in conduction with the drain of the third transistor to control the power supply voltage to be in electrical conduction with the light-emitting module.

8. The display module of claim 7, further comprising a plurality of scan lines extending in a first direction and a plurality of data lines extending in a second direction, wherein the first direction is perpendicular to the second direction, and the plurality of pixel units are respectively located at intersections between the plurality of scan lines and the plurality of data lines; wherein the signal transmission module is connected to the data line, the scan line, the first drive module, and the second drive module, wherein the signal transmission module is configured to receive the data signal of the first polarity and the data signal of the second polarity from the data line, and to transfer the data signal of the first polarity to the first drive module and transfer the data signal of the second polarity to the second drive module.

9. The display module of claim 8, wherein the second drive module is connected to the power supply voltage, and configured to control, upon receiving the data signal of the second polarity, the power supply voltage to be electrical conduction with the light-emitting module according to the data signal of the second polarity, to drive the light-emitting module to emit light.

10. The display module of claim 9, wherein the second drive module comprises a second voltage-stabilizing unit and a second drive unit, wherein the second voltage-stabilizing unit is connected to the signal transmission module and the power supply voltage, and is configured to receive and store the data signal of the second polarity from the signal transmission module, and to apply a stable voltage to the light-emitting module during the light emission of the light-emitting module; and the second drive unit is connected to the signal transmission module, the power supply voltage, and the light-emitting module, and configured to receive the data signal of the second polarity from the signal transmission module, and to control the power supply voltage to be in electrical conduction with the light-emitting module according to the data signal of the second polarity, to control the light-emitting module to emit light.

11. The display module of claim 10, wherein a gate of the first transistor is connected to the scan line, and the source of the first transistor is connected to the data line, wherein when the first transistor receives a scan signal from the scan line through the gate of the first transistor, the source of the first transistor is in conduction with the drain of the first transistor, and the first transistor receives the data signal of the first polarity or the data signal of the second polarity from the data line.

12. The display module of claim 11, wherein the second voltage-stabilizing unit comprises a fourth transistor and a second capacitor, and the second drive unit comprises a fifth transistor;

a gate of the fourth transistor is connected to the source of the first transistor, a source of the fourth transistor is connected to the drain of the first transistor, and a drain of the fourth transistor is connected to the second capacitor, wherein when the fourth transistor receives the data signal of the second polarity through the gate of the fourth transistor, the source of the fourth transistor is in electrical conduction with the drain of the fourth transistor, and the fourth transistor receives the data signal of the second polarity from the drain of the first transistor;

one end of the second capacitor is connected to the drain of the fourth transistor, and another end of the second capacitor is connected to the power supply voltage, wherein when the source of the fourth transistor is in conduction with the drain of the fourth transistor, the second capacitor is charged with the power supply voltage; and a gate of the fifth transistor is connected to the drain of the first transistor, a source of the fifth transistor is connected to the power supply voltage, and a drain of the fifth transistor is connected to the light-emitting module, wherein when the fifth transistor receives the data signal of the second polarity from the drain of the first transistor through the gate of the fifth transistor, the source of the fifth transistor in conduction with the drain of the fifth transistor to control the power supply voltage to be in electrical conduction with the light-emitting module.

13. A display device, comprising a support frame, a power supply module, and a display module, wherein the display module comprises a data drive circuit, a display control circuit, a light-emitting controller, and a display panel comprising a plurality of pixel units arranged in an array, and the plurality of pixel units are configured to receive data signals for image display;

during continuous display of two frames of images, each of the plurality of pixel units is configured to receive a data signal of a first polarity to perform image display when an $N^{th}$ frame of image in the two frames of images is displayed, and to receive a data signal of a second polarity to perform image display when an $(N+1)^{th}$ frame of image in the two frames of images is displayed, wherein the first polarity is opposite to the second polarity, and N is an integer greater than or equal to zero;

each of the plurality of pixel units comprises a first drive module, a second drive module, and a light-emitting module, wherein the first drive module is electrically connected to the light-emitting module and the second drive module is electrically connected to the light-emitting module, and the first drive module is configured to receive the data signal of the first polarity and to control the light-emitting module to emit light according to the data signal of the first polarity;

the first drive module comprises a first voltage-stabilizing unit and a first drive unit, wherein the first voltage-stabilizing unit is connected to the light-emitting module, and is configured to receive and store the data signal of the first polarity, and to apply a stable voltage to the light-emitting module during light emission of the light-emitting module, and wherein the first drive unit is connected to a power supply voltage and the light-emitting module, and configured to control the power supply voltage to be in electrical conduction with the light-emitting module according to the data signal of the first polarity, to control the light-emitting module to emit light;

the second drive module is configured to receive the data signal of the second polarity and to control the light-emitting module to emit light according to the data signal of the second polarity; and the data drive circuit is configured to receive a source output control signal from the display control circuit and to output the data signals according to the source output signal, a scan drive circuit in a non-display region of the display panel is configured to receive a gate output control signal from the display control circuit and to output scan signals according to the gate output control signal, the plurality of pixel units in the display panel are configured to perform image display according to the scan signals and the data signals under the control of the light-emitting controller; and the power supply module is configured to apply a power supply voltage to the display panel to perform image display, and the display module and the power supply module are fixed to the support frame, wherein each of the plurality of pixel units comprises a signal transmission module, and the signal transmission module comprises a first transistor, wherein the first voltage-stabilizing unit comprises a second transistor and a first capacitor, and the first drive unit comprises a third transistor;

a gate of the second transistor is connected to a source of the first transistor, a source of the second transistor is connected to a drain of the first transistor, and the drain of the first transistor is connected to the first capacitor, wherein when the second transistor receives the data signal of the first polarity through the gate of the second transistor, the source of the second transistor is in electrical conduction with the drain of the second transistor, and the second transistor receives the data signal of the first polarity from the drain of the first transistor;

one end of the first capacitor is connected to the drain of the second transistor, another end of the first capacitor is connected to the light-emitting module, and the first capacitor is configured to receive the data signal of the first polarity from the drain of the second transistor and to apply a stable voltage to the light-emitting module; and a gate of the third transistor is connected to the drain of the first transistor, a source of the third transistor is connected to the power supply voltage, and a drain of the third transistor is connected to the light-emitting module, wherein when the third transistor receives the data signal of the first polarity through the gate of the third transistor, the source of the third transistor is in conduction with the drain of the third transistor to control the power supply voltage to be in electrical conduction with the light-emitting module.

14. The display device of claim 13, further comprising a plurality of scan lines extending in a first direction and a plurality of data lines extending in a second direction, wherein the first direction is perpendicular to the second direction, and the plurality of pixel units are respectively located at intersections between the plurality of scan lines and the plurality of data lines; wherein the signal transmission module is connected to the data line, the scan line, the first drive module, and the second drive module, wherein the signal transmission module is configured to receive the data signal of the first polarity and the data signal of the second polarity from the data line, and to transfer the data signal of the first polarity to the first drive module and transfer the data signal of the second polarity to the second drive module.

15. The display device of claim 14, wherein the second drive module is connected to the power supply voltage, and configured to control, upon receiving the data signal of the second polarity, the power supply voltage to be electrical conduction with the light-emitting module according to the data signal of the second polarity, to drive the light-emitting module to emit light.

16. The display device of claim 15, wherein the second drive module comprises a second voltage-stabilizing unit and a second drive unit, wherein the second voltage-stabilizing unit is connected to the signal transmission module and the power supply voltage, and is configured to receive and store the data signal of the second polarity from the signal transmission module, and to apply a stable voltage to the light-emitting module during the light emission of the light-emitting module; and the second drive unit is connected to the signal transmission module, the power supply voltage, and the light-emitting module, and configured to receive the data signal of the second polarity from the signal transmission module, and to control the power supply voltage to be in electrical conduction with the light-emitting module according to the data signal of the second polarity, to control the light-emitting module to emit light.

17. The display device of claim 16, wherein a gate of the first transistor is connected to the scan line, and the source of the first transistor is connected to the data line, wherein when the first transistor receives a scan signal from the scan line through the gate of the first transistor, the source of the first transistor is in conduction with the drain of the first transistor, and the first transistor receives the data signal of the first polarity or the data signal of the second polarity from the data line.

* * * * *